US007530147B2

(12) United States Patent
Noelle et al.

(10) Patent No.: US 7,530,147 B2
(45) Date of Patent: May 12, 2009

(54) MACHINE FOR PRODUCTION OF NON-WOVEN MATERIAL, ADJUSTMENT PROCEDURE FOR THE SAME AND NON-WOVEN MATERIAL PRODUCED THUS

(75) Inventors: Frédéric Noelle, Saint Nazaire les Eymes (FR); Rolf Helmut Joest, Duisburg-Reinhausen (DE); Peter Anderegg, Winterthur (CH)

(73) Assignee: Rieter Automatik GmbH, Grossostheim (DE)

( * ) Notice: Subject to any disclaimer, the term of this patent is extended or adjusted under 35 U.S.C. 154(b) by 169 days.

(21) Appl. No.: 10/580,793

(22) PCT Filed: Nov. 26, 2004

(86) PCT No.: PCT/FR2004/003040

§ 371 (c)(1),
(2), (4) Date: May 26, 2006

(87) PCT Pub. No.: WO2005/054558

PCT Pub. Date: Jun. 16, 2005

(65) Prior Publication Data

US 2007/0042662 A1 Feb. 22, 2007

(30) Foreign Application Priority Data

Nov. 27, 2003 (FR) ..... 03 13918

(51) Int. Cl.
*D04H 3/00* (2006.01)

(52) U.S. Cl. ..... 19/299

(58) Field of Classification Search ..... 19/296, 19/299

See application file for complete search history.

(56) References Cited

U.S. PATENT DOCUMENTS

| | | | | |
|---|---|---|---|---|
| 3,698,610 | A * | 10/1972 | Feltgen et al. | 226/7 |
| 4,089,720 | A | 5/1978 | Haley | |
| 4,952,265 | A | 8/1990 | Yamanaka et al. | |
| 5,093,069 | A * | 3/1992 | Mellem et al. | 264/510 |
| 6,588,080 | B1 | 7/2003 | Conrad et al. | |
| 7,377,762 | B2 * | 5/2008 | Nishibori et al. | 425/71 |

FOREIGN PATENT DOCUMENTS

| | | | |
|---|---|---|---|
| DE | 43 09 990 | A | 10/1994 |

* cited by examiner

*Primary Examiner*—Shaun R Hurley
(74) *Attorney, Agent, or Firm*—Pearne & Gordon LLP

(57) ABSTRACT

A machine for producing a nonwoven feeds continuous filaments onto two surfaces that form a convergent passage. At least one of the surfaces is moving to drive the continuous filaments through the passage to form the nonwoven web. The continuous filaments have filament portions that are respectively received on the two surfaces to form spaced lateral web parts joined by a central web part formed by the continuous filament portions bridging the convergent passage. A vacuum is applied through the surfaces to assist placement of the filament portions and to direct the web as it emerges from the passage onto a horizontal take-up conveyor.

20 Claims, 4 Drawing Sheets

MACHINE FOR PRODUCTION OF NON-WOVEN MATERIAL, ADJUSTMENT PROCEDURE FOR THE SAME AND NON-WOVEN MATERIAL PRODUCED THUS

The present invention relates to nonwoven production machines, to their regulating methods and to the nonwovens obtained using these machines.

Federal Republic of Germany Patent No. 1 785 712 describes a nonwoven production machine which includes means for ejecting continuous filaments as a horizontal curtain into the nip between two rotationally driven rolls having horizontal axes. The filaments are deposited as a web onto the two rolls, which define a passage that converges from the entry to the exit. A nonwoven comprising continuous filaments is thus obtained in which, in a central part, the filaments are oriented predominantly, for most of a filament, perpendicular to the surfaces of the nonwoven and the two lateral parts are predominantly oriented, for most of a filament, parallel to the surfaces of the nonwoven (referred to as a Z structure). A number of filaments extend both into the central part and into the lateral parts, namely the upper part and the lower part.

Machines in which the filaments are projected horizontally have been entirely superseded technically by machines in which the filaments are ejected vertically, and especially by spunbond machines which give symmetrical nonwovens, since the effect of gravity does not introduce any dissymmetry. These spunbond machines consist in general, in succession from the top downwards, of an extruder for a molten organic polymer feeding a spinneret, allowing a curtain of continuous filaments to be produced, of a cooling zone, allowing at least a surface part of the extruded filaments to be solidified, of a suction device, in which the filament curtain is subjected to the action of high-velocity air streams causing the filaments to be attenuated, and of a means for deflecting and slowing down the flow of air, allowing the filaments to be distributed randomly on a conveyor. However, these spunbond machines do not allow products of the type of those produced by the machine of the abovementioned Federal Republic of Germany patent to be obtained.

In patent U.S. Pat. No. 4,089,720, the web is kept compressed between two conveyors at the exit of the two rolls. This compression of the web, which is still barely coherent and fragile undermines the desired Z structure, which is thus obtained only transiently. In DE-4 209 990, the aim is to obtain the Z structure by a balancing mechanism and not by a convergent passage, and thus the web is compressed right from the exit of the rolls between two conveyors. U.S. Pat. No. 4,952,265 describes a special technique with the use of water in a passage, which is not convergent between the rolls. In U.S. Pat. No. 6,588,080 B1, the web remains oriented vertically after exiting the rolls. The Z structure is deformed under the very weight of the web. The Z structure is obtained only transiently.

The aim of the invention is to provide a nonwoven production machine for producing in particular nonwovens of the type indicated above, but by a machine in which the continuous filaments are ejected vertically, especially in a spunbond machine, thus maintaining the possibility of easily obtaining symmetrical nonwovens and in particular with the possibility of adjusting in a hitherto unequalled manner the operation of the machine.

One subject of the invention is therefore a machine for producing a nonwoven, comprising means for ejecting continuous filaments onto two surfaces, at least one of which is moving, and means for depositing the ejected filaments as a web, defining a convergent passage for the web between which surfaces by making said web descend from an entry to an exit and through which passage they drive the web, characterized in that, at the exit, means are provided for deflecting the web in a direction other than the vertical onto a conveyor for taking up the web, said web being, after the exit and as far as the conveyor, only in contact with at most one conveyor. Thus, the Z structure of the web is maintained. The deflection means are such that, at any point between the exit and the subsequent setting of the structure of the web, the deflected web is in contact only with one conveyor. The change in direction takes place immediately at the exit, after the most convergent point. The direction going from the entry to the exit is a descending direction, preferably the vertical direction.

Whereas in the abovementioned Federal Republic of Germany patent the main preoccupation was to collect the web exiting the two rolls by ensuring that this web was horizontal, thus being very easy to take up and to be supported by a conveyor, and consequently the curtain of filaments being ejected horizontally, the invention grows counter to this technique. It has now been understood that the difficulty in picking up a web that is not horizontal can be resolved very much more easily than the problems due to gravity posed by a horizontal curtain of filaments.

Preferably, means for deflecting the web in a direction other than the vertical direction are provided, especially means for deflecting the web in the horizontal direction.

By deflecting the web from the vertical direction to the horizontal direction on exiting the convergent passage, it is now possible to benefit from all the advantages of the spunbond tower and, even better, it is possible to take advantage of the existence of a new regulated parameter, namely the position of the start of the web and especially the level of the web, in order to vary a regulating parameter and thus ensure, easily and precisely, that the machine operates correctly.

This is why another subject of the invention is a method of regulating a nonwoven production machine, in which a web of continuous filaments is deposited on a moving surface, a regulated parameter associated with the web is taken and a regulating parameter of the machine is set according to the regulated parameter taken, characterized in that arrangements are made so that the position of the start of the web can vary and the position of the start of the web is taken as the regulated parameter. In particular, arrangements are made so that the web has a descending initial portion, especially a vertical portion, and the level of the start of the web is taken.

There is thus a regulated parameter which is associated directly with the web, the detection of which is not destructive, and which most particularly is associated with the start of the web. The reaction speed should there be a malfunction of the production machine is thus more rapid, on the one hand because the regulated parameter is associated with the web and is taken as soon as possible on this web and, on the other hand, because the position or level can be detected almost immediately using very high-speed optical devices.

The subject of the invention is also a nonwoven comprising continuous filaments, in which, in a central part, the filaments are mostly oriented, for the greater part of a filament, perpendicular to the surfaces of the nonwoven and, in the two lateral parts, they are mostly oriented, for the greater part of a filament, parallel to the surfaces of the nonwoven, in which nonwoven, in a central part, filaments are mostly oriented, for the greater part of a filament, perpendicular to the surfaces of the nonwoven and, in two lateral parts, they are mostly oriented, for a large part of a filament, parallel to the surfaces of the nonwoven, at least a number of filaments extending both into the central part and into the lateral parts, characterized in that a lateral part has a filament orientation, a thickness and/or a density different from that of the other lateral part.

In the machine according to the invention, the two moving deposition surfaces may be provided by a first roll and by a second roll, which rotate in opposite senses, the nip between which defines the passage. Preferably, means for regulating the nip between the two rolls and/or the rotation speed of the two rolls are provided. By regulating the nip between the two rolls, it is possible to maintain a certain quantity of filament upstream of the exit or point of convergence of the passage and it is also possible in this way to adjust the size of the filament loops during their deposition. By regulating the rotation speed of the rolls, it is also possible to regulate the quantity of filament present in the convergent passage upstream of the exit. Means may also be provided for synchronizing the change in rotation speed of the rolls to the speed of a web take-up conveyor after the deflection means. The rolls may have different diameters. According to another embodiment, two conveyors passing over the rolls are provided that converge on the nip, these conveyors defining the convergent passage and preferably being provided with means for regulating the angle of convergence. This regulation also allows the quantity of filament present in the passage upstream of the exit to be regulated.

In both cases, suction is provided inside the rolls. Each roll may consist of a central, stationary part about which a rigid air-permeable cylinder rotates, which is itself covered with a sleeve or fabric. The suction may also be regulated in order to influence the shape of the filament loops and their deposition on the surface of the rolls. It is thus possible to form lateral parts of variable thickness on the surface of the rolls and thus modify the ratio of the lateral parts of the web, where the filaments are somewhat horizontal when the web is horizontal, to the filaments of the central part of the web, which are somewhat vertical, that is to say oriented in the thickness direction of the web. Preferably, each roll has its own suction means.

The dimension of the passage at the exit, or minimum distance between the two rolls or the two conveyors that pass there through, is preferably between 0.5 and 50 mm. The angle of convergence is preferably between 20° and 120°. The dimension of the passage at the entry is preferably between 10 and 400 mm. The radius of the rolls is preferably between 50 and 500 mm.

According to a preferred embodiment, the means for deflecting the filaments are formed by the fact that the first roll has a larger suction zone than the second roll. In particular, there are provided a first compartment, bounded on the inside of the first roll by radial walls at a position between 12 o'clock and 10 o'clock and a position between 8 o'clock and 5 o'clock, preferably between 7 o'clock and 6 o'clock, respectively, and a second compartment inside the second roll, bounded by radial walls at a position between 12 o'clock and 2 o'clock and a position between 2 o'clock and 4 o'clock respectively, and by means A for creating an underpressure in these two compartments. Preferably, the first compartment is subdivided into two, upper and lower, subcompartments each having their own suction means. The web formed in the passage is pressed against the first roll until it adopts a usually horizontal direction and is supported by a conveyor, as is usual in spunbond machines.

According to one embodiment of the invention, a device for feeding an additional material into the filaments is provided. The additional material may be a bonding material and/or fibres, filaments and/or composite filaments that include bonding material. The bonding agents may be injected into the filaments before and/or after the convergent passage. Bicomponent filaments may also be produced directly by the spunbond tower, one part of the filaments being formed by a bonding agent. The filaments may also be bicomponent filaments only along the sides of the spinneret in such a way that they are then mainly located in the nonwoven along the lateral parts. It is also possible to introduce the fibres into the spunbond tower in meltblown form or as short fibres. Fibres may also be deposited on the surface of the web by means of an airlaid machine. After exiting the passage and after the web has been deflected, it can be consolidated by a heating device, when it includes a bonding agent, by a compression device, by a water-jet consolidation device or by a mechanical needling consolidation device. A device for gauging the web downstream of the passage may also be provided.

In the nonwovens obtained, preferably the density of the central part is lower than that of a lateral part, preferably by at least 10%. Preferably, the weight per unit area of the nonwoven is 50 to 2000 g/m$^2$ and preferably 200 to 1200 g/m$^2$. It preferably has a thickness of 1 to 100 mm, the central part having a thickness preferably representing more than 50% and preferably between 50% and 90% of the thickness of the nonwoven. The content of bonding agent is preferably smaller in the central part than in the lateral parts. Preferably, the filaments have a higher linear density than 3 dtex.

A final subject of the invention is the use of a nonwoven comprising continuous filaments, in which nonwoven, in a central part, filaments are oriented predominantly, for most of a filament, perpendicular to the surfaces of the nonwoven and, in two lateral parts, they are predominantly oriented, for most of a filament, parallel to the surfaces of the nonwoven, at least a number of filaments extending both into the central part and into the lateral parts, as structural material, particularly one having acoustic properties. Owing to the alignment approximately perpendicular to the surface of the filaments in the central part, the nonwoven withstands pressure in the cross direction well. With bonding agent and a supply of fibres below 10 dtex, there is even elastic (foam) behaviour. The horizontally aligned and consolidated filaments in the two lateral parts give good flexural strength and prevent any penetration of a sharp object into the nonwoven.

Advantageously, the nonwoven may be used for vehicles in the automobile, railway and aeronautical industries because of its good acoustic properties due to its thickness (>10 mm) and to its rigidity, sufficient for it to be self-supporting. In particular, it may be used as an automobile roof or door panel that absorbs sound well and has a stable shape, being covered on one or both of its faces with a decorative air-permeable coating.

The nonwoven may also be used as a casing for domestic electrical appliances, printers or copiers. It may be used as an insulating material for constructions and buildings and also as damping layers for floors and even for roads. It may be combined with a coating giving rigidity.

The invention also relates to a material comprising the nonwoven according to the invention coated with a nonwoven obtained by meltblowing, preferably on only one of the surfaces. This novel product has the following properties:

resilience;

very good delamination;

ability to be moulded and thermoformed;

AFR (Air Flow Resistance, Rt, see WO 2004/088025) between 150 and 6000 Ns/m$^3$; and very good acoustic properties.

Material characteristics used:

SB (Spunbond): PET+CoPET, PBT+CoPBT in 50%-50%, or 90%-10%, preferably 70%-30%, proportions by weight;

weight per unit area: 500-2000 g/m$^2$;

filament diameter; 20-60 μm;

MB (Meltblown): PET, CoPET, PBT, CoPBT, PP, PA, PE;

weight per unit area: 10-100 g/m$^2$;

fibre or filament diameter: 1-10 μm;

PET: polyester;

CoPET: copolyester;

PBT: polybutylene;

CoPBT: copolybutylene;

PP: polypropylene;

PA: polyamide;

PE: polyethylene.

The meltblowing process is a process in which a molten polymer is extruded into a high-velocity hot gas vapour, which converts it into fibres. The molten plastic is blown by high-velocity hot gas through the lips of the die of the extruder. The filaments output by the extruder are attenuated during their formation until they crack. The fibres break into pieces of short length rather than being continuous, like those formed in spunbond nonwovens. The short fibres thus produced are spread out by cooling air onto a moving belt, called a forming fabric, or onto a drum, where they become attached to one another in order to form a white opaque web of thin fibres.

In the appended drawings, given solely by way of example:

FIG. 3 is a schematic sectional view of a nonwoven according to the invention;

Figure 1:
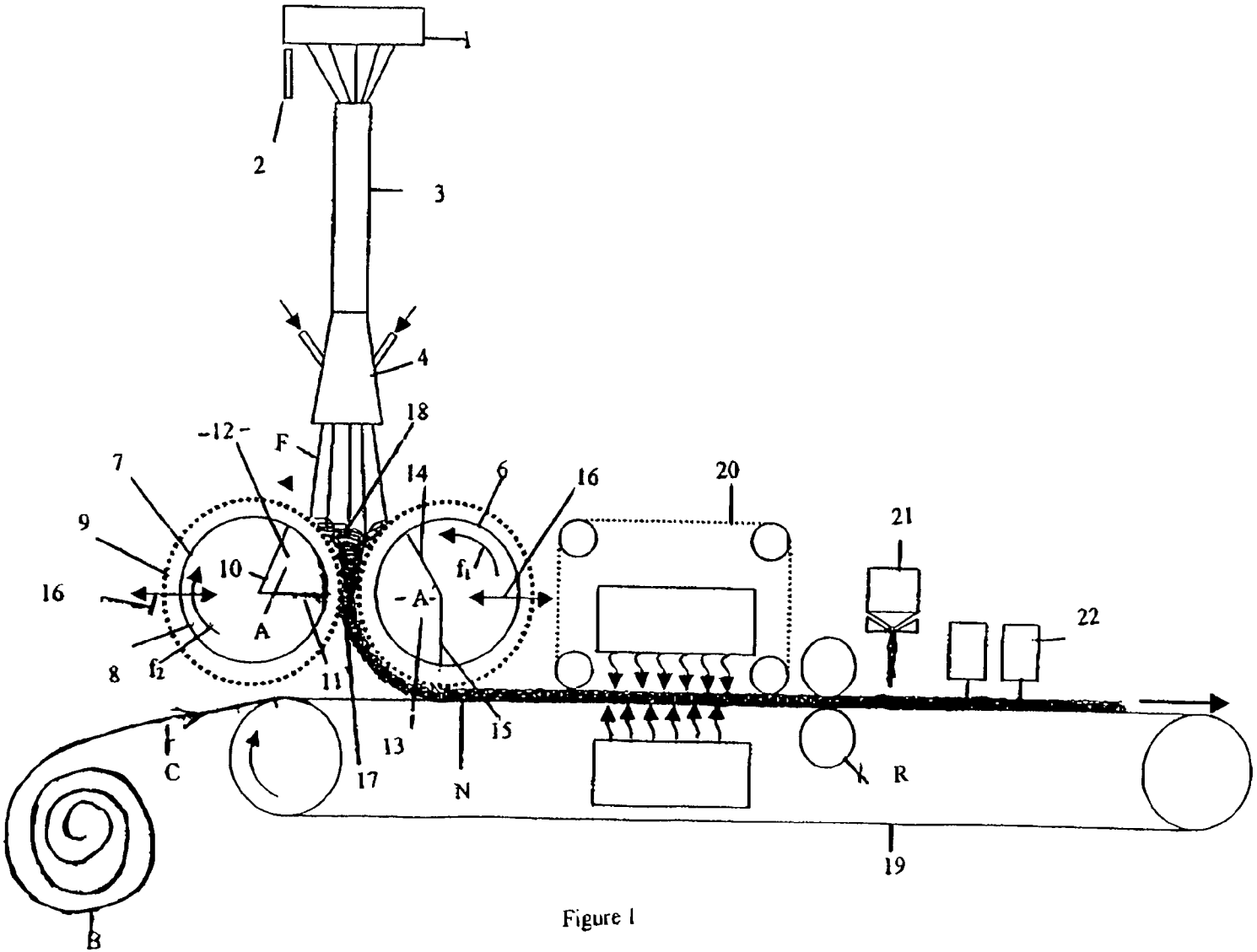
FIG. 1 is a schematic sectional view of a machine according to the invention.

The machine of FIG. 1 comprises a spunbond tower having, at the top, a spinneret 1 followed by a cooling zone 2 and, still going downwards, by a suction device 3 for attenuating the filaments and by a diffuser 4, which sends the filaments F, as a curtain perpendicular to the plane of the drawing, into the nip between two rolls 6 and 7 of horizontal axes. Each roll consists of a stationary cylinder 8 surrounded by an air-permeable sleeve 9 of 250 mm radius. Defined in the cylinder 8 of the second roll by radial walls 10, 11 is a compartment 12. The walls extend over the entire length of the cylinder 8. The wall 10 is, as considered in cross section of the roll and as may be seen in the figure, at the 1 o'clock position, whereas the wall 11 is at the 3 o'clock position. Suction shown schematically by the letter A creates an underpressure in the compartment 12. Also provided in the first roll 6 on the right, in the same manner as in the second roll 7 on the left, is a chamber 13 bounded by a wall 14 at 11 o'clock and by a wall 15 at 6 o'clock. The rolls are rotationally driven at the same speed along the respective directions of the arrows $f_1$ and $f_2$. The double-sided arrows 16 indicate the possibility for each roll to be moved closer to or further from the other, thereby modifying the minimum distance between the two rolls that corresponds to the exit 17 of the passage defined between the two rolls, the entry of this passage corresponding to the level 18 where the filaments are deposited on the rolls, thus creating a mass of filaments between the entry 18 and the exit 17.

Thanks to the underpressure A created in the chamber 13, the web N formed by the compression exerted by the rolls 6 and 7 on the mass of filaments is deflected towards the right so as to take up a horizontal position and, by being taken up by the upper run of a conveyor 18, passes onto a device 20 for heating both sides, between two gauging rolls R and then onto a meltblown deposition device 21 and onto a water-jet or hot (70-90° C.) calendering consolidation device 22. A functional layer C output from a reel B also passes beneath the web N.

Figure 2:
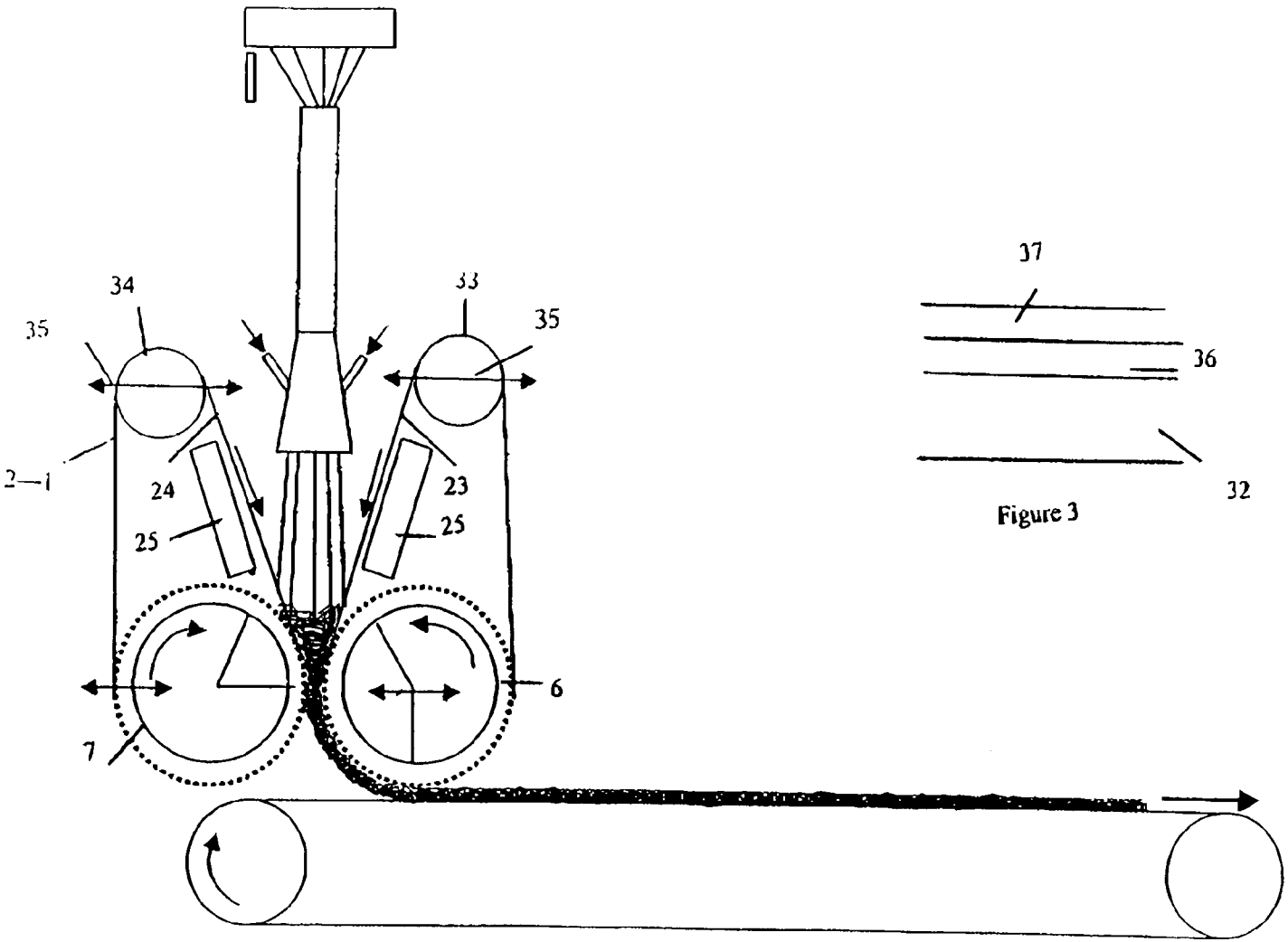
FIG. 2 is a view similar to FIG. 1 of an alternative embodiment.
Figure 4:
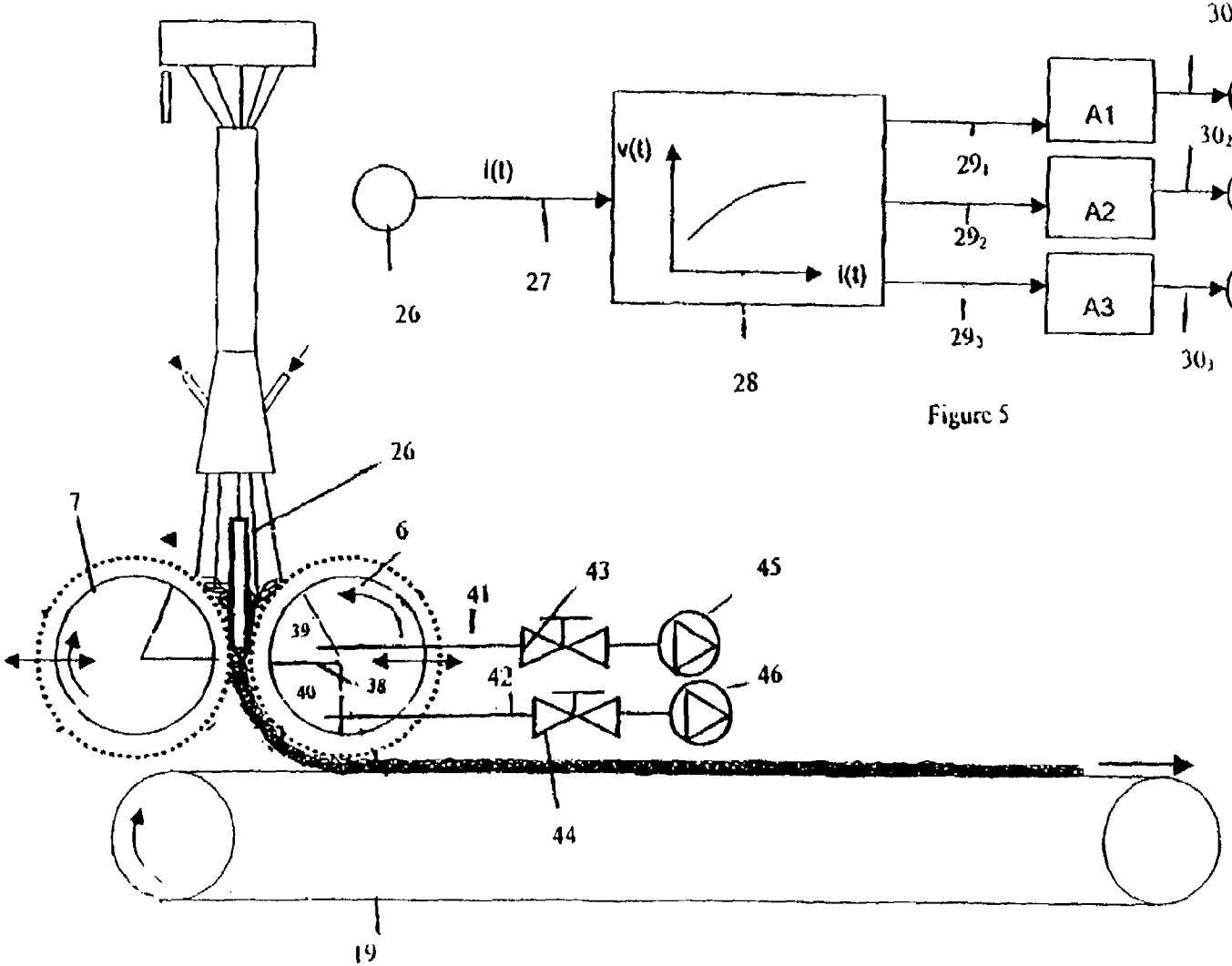
FIG. 4 is a partial schematic sectional view corresponding to FIG. 1 and illustrating the elements for regulating the operation.

The machine shown in FIG. 2 differs from that of FIG. 1 in that the rolls 6, 7 serve as return rolls for conveyors 23, 24 that converge on the passage and are provided with suction boxes 25, The conveyors 23, 24 pass over respective return rolls 33 and 34 placed above the rolls 6 and 7. The distance between the rolls 33 and 34 may be regulated, as indicated by the arrows 35, so that the angle of convergence of the rolls 33, 34 can be regulated, FIG. 4 illustrates, in one embodiment according to FIG. 1, the regulation of the level of the mass of filaments at the entry of the convergent passage between the rolls. A photoelectric cell 26 having multiple light beams detects the level of the mass of filaments in the passage. A radial wall 38 subdivides the first compartment into two subcompartments 39 and 40 which communicate respectively, via lines 41, 42, with valves 43, 44 with the suction from vacuum pumps 45, 46.

Figure 5:
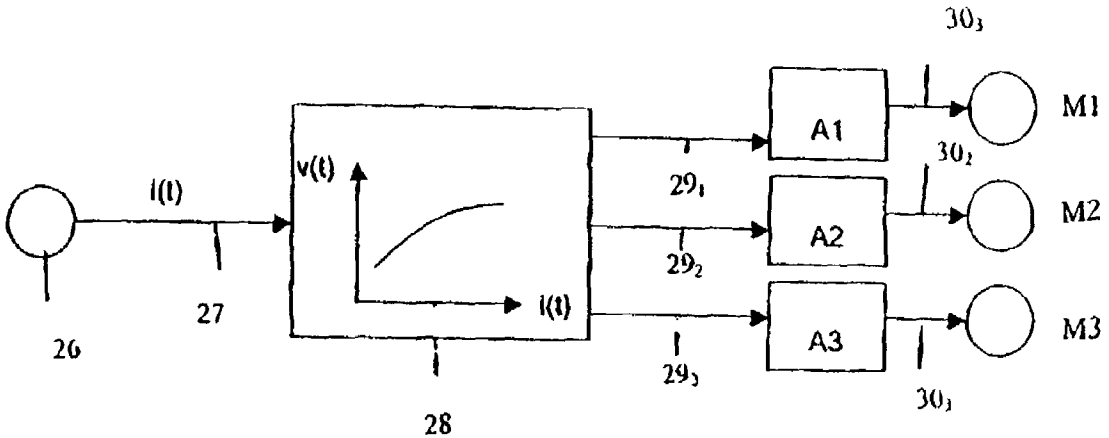
FIG. 5 is an electronic diagram for the regulating circuit.

FIG. 5 shows schematically the regulating circuit. The detector 26 sends level signals L(t) via a line 27 to a controller 28 which controls the rotation speed T of the rolls according to the level signal and consequently sends speed signals via lines 29-1, 29-2 and 29-3 to amplifiers A1, A2, A3, which drive, via lines 30-1, 30-2 and 30-3, motors M1, M2, M3 for driving the rolls 6, 7 and the driving roll of the conveyor 19. The controller 28 also synchronizes the change in speed of the motors M1 and M2 to the change in speed of the motor M3 or vice-versa.

Figure 6:
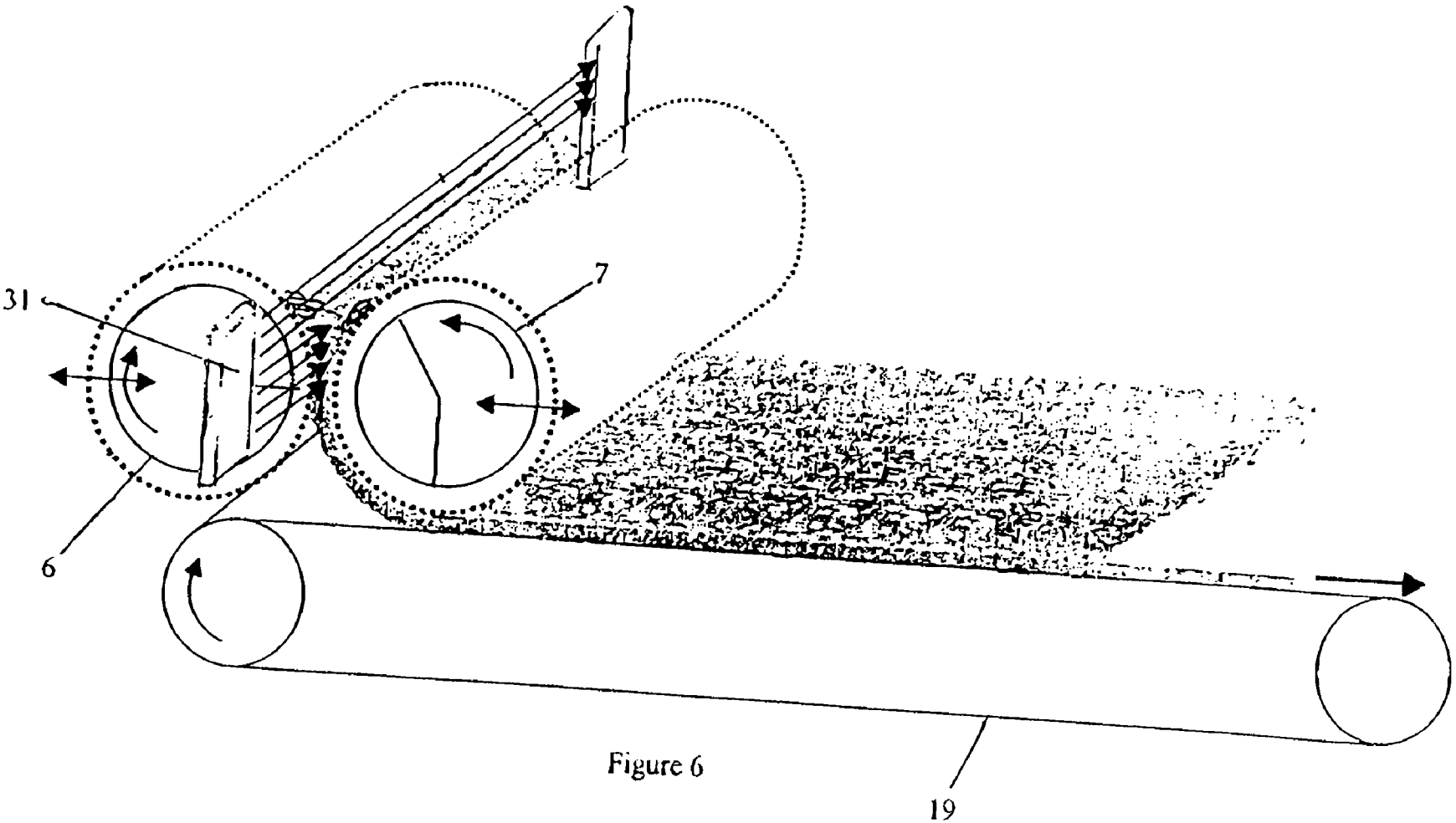
FIG. 6 is a partial view in perspective illustrating another method of regulation for obtaining the nonwoven of FIG. 3.

FIG. 6 is a perspective view showing the presence of a laser beam 31 for detecting the level of the mass of filaments in the passage between the rolls. The signals obtained by this detector are used to control the rotation speeds of the rolls 6, 7 and/or of the driving roll of the conveyor 19, the distance between the rolls 6, 7 and/or the angle of inclination of the conveyors 23, 24.

Thus, by controlling these regulating parameters by means of this detector 31, it is possible to give the web different characteristics, especially thickness, and to obtain a nonwoven shown in FIG. 3. The nonwoven comprises a central part 36 and lateral parts 32, 37, the thickness of which is substantially the same over the entire length of the nonwoven. In the central part 36, the filaments are essentially directed parallel to the surfaces of the nonwoven, whereas in the lateral parts 32, 37 they are essentially perpendicular to these large surfaces. On average, the direction of the filaments is more perpendicular to the surfaces of the nonwoven in at least one of the lateral parts than in the central part. However, the lateral part 32 is thicker than the lateral part 37 and/or less dense and/or with a different orientation of the filaments. This difference between the two lateral parts 32, 37 is obtained by applying a different angle of inclination between the conveyor 23 and the conveyor 24 and/or by giving the rolls 6, 7 different diameters and/or different speeds.

The invention claimed is:

1. A machine for producing a nonwoven comprising means for ejecting continuous filaments onto two surfaces, at least one of which is moving, said surfaces forming a convergent passage having an entry and an exit, depositing means for depositing the ejected filaments onto said surfaces to be driven through said passage in descending travel from said entry to said exit to form a web, said web being formed with spaced lateral web parts joined by a central web part, said deposited continuous filaments having filament portions respectively supported on said two surfaces to form said lateral parts and extending across said convergent passage to form said central part joining said lateral parts, and deflection means at said exit for deflecting the web in a direction other than the vertical onto a take-up conveyor for taking up the web.

2. A machine according to claim 1, wherein said direction other than the vertical is the horizontal.

3. A machine according to claim 2, wherein said two surfaces are provided by first and second rolls, said first and second rolls forming said passage as a nip between the rolls.

4. A machine according to claim 3, further including regulating means and synchronizing means, said regulating means regulating the rotational speed of said first and second rolls, and said synchronizing means synchronizing a change in said rotational speed of said rolls to a change in speed of said web take-up conveyor located after said deflection means.

5. A machine according to claim 4, further characterized by a change in speed of said web take-up conveyor after said deflection means.

6. A machine according to claim 3, further including nip regulating means for regulating the size of said nip.

7. A machine according to claim 2, wherein said two surfaces are formed by two conveyors passing over two rolls forming a nip, said two conveyors converging towards said nip.

8. A machine according to claim 7, further including convergence-angle means for regulating the angle of convergence of said conveyors toward said nip.

9. A machine according to claim 3, wherein said rolls have an air-permeable surface and suction means are provided inside said rolls for providing a reduced pressure along at least a portion of said air-permeable surface.

10. A machine according to claim 9, further including suction control means for regulating the suction provided by said suction means.

11. A machine according to claim 9, wherein said suction means are provided inside each of said rolls.

12. A machine according to claim 11, wherein said suction means include a first compartment inside said first roll and a second compartment inside said second roll, said first compartment being bounded by first radial walls respectively located at a position between 12 o'clock and 10 o'clock and a position between eight o'clock and five o'clock, said second compartment being bounded by second radial walls respectively located at a position between 12 o'clock and two o'clock, and a position between two o'clock and four o'clock, said suction means providing a reduced pressure in each of the compartments.

13. A machine according to claim 12, wherein said first compartment is subdivided into upper and lower subcompartments, and said suction means provides a reduced pressure in each of said subcompartments.

14. A machine according to claim 1, further including a feed device for feeding an additional material into said passage.

15. A machine according to claim 14, wherein said additional material is a bonding material and/or fibers and/or filaments, said filaments being composite filaments that include bonding material.

16. A machine according to claim 15, further including a heating device for heating said web downstream of said passage.

17. A machine according to claim 16, further including a gauging device for gauging said web downstream of said passage.

18. A machine according to claim 17, further including a consolidating device for consolidating said web downstream of said passage.

19. A machine according to claim 1, wherein said two surfaces are arranged and spaced to support a vertically extending quantity of said deposited continuous filaments upstream of said exit.

20. A machine according to claim 1, wherein said continuous filament portions forming said spaced lateral web parts are arranged in a first orientation relative to said web and said continuous filament portions forming said central web part are arranged in a second orientation relative to said web different from said first orientation.

* * * * *